US006734764B2

(12) United States Patent
Endou et al.

(10) Patent No.: US 6,734,764 B2
(45) Date of Patent: May 11, 2004

(54) SHIELD FOR DIELECTRIC FILTER AND DIELECTRIC FILTER EQUIPPED WITH THE SAME

(75) Inventors: Kenji Endou, Chuo-ku (JP); Osamu Takubo, Chuo-ku (JP)

(73) Assignee: TDK Corporation, Chuo-ku (JP)

( * ) Notice: Subject to any disclaimer, the term of this patent is extended or adjusted under 35 U.S.C. 154(b) by 0 days.

(21) Appl. No.: 10/112,516

(22) Filed: Mar. 28, 2002

(65) Prior Publication Data

US 2002/0140528 A1 Oct. 3, 2002

(30) Foreign Application Priority Data

Mar. 29, 2001 (JP) ..... 2001-097017

(51) Int. Cl.[7] ..... H01P 1/205
(52) U.S. Cl. ..... 333/202; 333/206
(58) Field of Search ..... 333/134, 202, 333/206, 207

(56) References Cited

U.S. PATENT DOCUMENTS 4,742,562 A * 5/1988 Kommrusch ..... 333/134
4,906,955 A * 3/1990 Yorita et al. ..... 333/207
5,130,682 A * 7/1992 Agahi-Kesheh ..... 333/202
5,218,329 A 6/1993 Vangala et al. ..... 333/206
5,278,527 A * 1/1994 Kenoun et al. ..... 333/202
5,666,093 A * 9/1997 D'Ostillio ..... 333/207
5,745,018 A 4/1998 Vangala ..... 333/202
5,789,998 A * 8/1998 Kim et al. ..... 333/134
6,400,239 B1 * 6/2002 Chun et al. ..... 333/206

FOREIGN PATENT DOCUMENTS

JP 07235805 A * 9/1995 ..... H01P/1/205
JP 09181503 A * 7/1997 ..... H01P/1/205
JP 2001053503 A * 2/2001 ..... H01P/1/205

* cited by examiner

*Primary Examiner*—Benny Lee
*Assistant Examiner*—Kimberly E Glenn
(74) *Attorney, Agent, or Firm*—Seed IP Law Group PLLC

(57) ABSTRACT

A shield that can prevent the thickness of a dielectric filter from increasing without increasing the manufacturing cost of the dielectric filter is disclosed. The shield of the present invention is to be attached to a dielectric filter and has a first plate, a second plate elongated from the first end of the first plate in a predetermined direction, a third plate elongated from the second end of the first plate opposite to the first end in the predetermined direction, and a projecting part projecting from the first plate at a portion between the first and second ends of the first plate. Since the shield can be fixed to the dielectric filter by pinching the both side of the dielectric block and the projecting part can be in contact with the metallization of the dielectric filter, the total thickness of the dielectric filter does not increase even the shield is attached.

18 Claims, 13 Drawing Sheets

SHIELD FOR DIELECTRIC FILTER AND DIELECTRIC FILTER EQUIPPED WITH THE SAME

BACKGROUND OF THE INVENTION

1. Field of the Invention

The present invention relates to a shield and a dielectric filter, and more specifically, to a shield that can prevent the thickness of a dielectric filter from increasing without increasing the manufacturing cost of the dielectric filter and a dielectric filter equipped with the shield.

2. Description of the Prior Art

In general, a dielectric block having through holes passing from one surface to the opposite surface and all of whose surfaces except said one surface are metallized is used to a dielectric filter. The through holes formed on the dielectric block work as resonators for the high frequency signal. A filter circuit such as a band pass filter circuit is formed by adding capacitance and so forth to the resonators.

When the dielectric filter is mounted on the printed circuit board, the metallization formed on the surfaces of the dielectric block is grounded. However, since the metallization formed on the top surface of the dielectric block (top metallization) is far from a ground electrode formed on the printed circuit board, the potential of the top metallization easily fluctuates. Because such a fluctuation may deteriorate the filter characteristic, grand potential is conventionally bypassed and given to the top metallization using a shield so as to reduce the fluctuation.

FIG. 1 is a schematic perspective view showing a conventional shield 1. FIG. 2 is a schematic sectional view showing the dielectric filter 5 equipped with the shield 1.

As shown in FIGS. 1 and 2, the conventional shield 1 is a metal plate shaped like a capital L having a first plate 2 and a second plate 3 perpendicular to the first plate 2. The shield 1 is fixed to the dielectric filter 5 by adhering the first plate 2 on the top metallization of the dielectric filter 5. When the dielectric filter 5 equipped with the shield 1 is mounted on the printed circuit board, the end of the second plate 3 and the ground electrode formed on the printed circuit board are electrically and mechanically connected so that the fluctuation of the potential on the top metallization of the dielectric filter 5 is restrained.

As described above, because the end of the second plate 3 of the conventional shield 1 is connected to the ground electrode formed on the printed circuit board, it is necessary that the end of the second plate 3 and the bottom surface of the dielectric filter 5 are coplanar when the shield 1 is attached to the dielectric filter 5. However, since the size and the shape of a dielectric block which constitutes the dielectric filter 5 depend on the manufacture conditions, it is extremely difficult to form the shield 1 so that the end of the second plate 3 and the bottom surface of the dielectric filter 5 are coplanar.

Further, because the shield 1 is grounded, the filter characteristics of the dielectric filter 5 changes with the gap between the second plate 3 and the dielectric filter 5. However, because the conventional shield 1 is attached to the top metallization of the dielectric filter 5, it is difficult to fix the gap between the second plate 3 and the dielectric filter 5 to a desired distance.

In order to solve the problems, a technique of using a shield shaped like a capital U is proposed by U.S. Pat. No. 5,745,018.

In recent years, not only small area but also thin shape is strongly required for the various components to be mounted on the printed circuit board. However, according to the technique disclosed on U.S. Pat. No. 5,745,018, because the shield is attached on the top metallization of the dielectric filter similar to another conventional technique shown in FIGS. 1 and 2, total thickness of the dielectric filter mounted on the printed circuit board should be increased.

Also, another technique that forming a cavity for storing a part of the shield on the dielectric block is proposed by U.S. Pat. No. 5,218,329. However, according to this technique, an additional process for forming the cavity is needed so that the manufacture cost should be increased.

BRIEF SUMMARY OF THE INVENTION

One of features of the present invention is to provide an improved shield for a dielectric filter that can prevent the thickness of the dielectric filter from increasing without increasing the manufacturing cost of the dielectric filter.

Another object of the present invention is to provide a dielectric filter equipped with such a shield.

The above and other objects of the present invention can be accomplished by a shield attachable to a dielectric filter, comprising:

- a first metallic plate;
- a second metallic plate elongated from a first end of the first metallic plate in a predetermined direction;
- a third metallic plate elongated from a second end of the first metallic plate opposite to the first end in the predetermined direction; and
- a metallic projecting part projecting from the first metallic plate at a portion between the first and second ends of the first metallic plate.

Because the shield according to the present invention can be attached to the dielectric filter such that the second and third metallic plates pinch the dielectric filter from the side surfaces thereof and that the metallic projecting part is in contact with the metallization of the dielectric filter, the shield does not increase total thickness of the dielectric filter equipped therewith. For this reason, it is enabled to satisfy the demand to thin the total thickness of the dielectric filter. Further, according to the present invention, the distance between the shield and the dielectric filter is fixed by the length of the metallic projecting part. Therefore, the distance does not vary so that the fluctuation of the filter characteristics can be avoided. Moreover, since the shield after attached to the dielectric filter has sufficient mechanical strength, the shield can be made of a thin metal plate.

In a preferred aspect of the present invention, a length of the metallic projecting part according to the predetermined direction is shorter than either lengths of the second and third metallic plates according to the predetermined direction.

In a further preferred aspect of the present invention, the metallic projecting part is elongated from a third end or its adjacent portion, the third end being perpendicular to the first end of the first metallic plate.

In a further preferred aspect of the present invention, the metallic projecting part is formed on substantially throughout between first and second ends of the first metallic plate.

In a further preferred aspect of the present invention, the metallic projecting part is formed by folding a part of the first metallic plate using slits formed on the first metallic plate.

In another preferred aspect of the present invention, the metallic projecting part is made of projection member attached to the first metallic plate.

In a further preferred aspect of the present invention, the first metallic plate has a removed portion at a fourth end opposite to the third end.

In a further preferred aspect of the present invention, the shield further comprises another metallic projecting part elongated from the fourth end or its adjacent portion.

The above and other objects of the present invention can be also accomplished by a shield attachable to a dielectric filter, comprising:

a first metallic plate;

a second metallic plate elongated from a first end of the first metallic plate in a predetermined direction;

a third metallic plate elongated from a second end of the first metallic plate opposite to the first end in the predetermined direction;

a first metallic projecting part projecting from the second metallic plate toward the third metallic plate; and a second metallic projecting part projecting from the third metallic plate toward the second metallic plate.

Because the shield according to the present invention can be attached to the dielectric filter such that the second and third metallic plates pinch the dielectric filter from the side surfaces thereof and that the first and second metallic projecting parts are in contact with the metallization of the dielectric filter, the shield does not increase total thickness of the dielectric filter equipped therewith. Further, according to the present invention, because the distance between the shield and the dielectric filter is fixed by the length of the first and second metallic projecting parts, the distance does not vary so that the fluctuation of the filter characteristics can be avoided. Moreover, since the shield after attached to the dielectric filter has sufficient mechanical strength, the shield can be made of a thin metal plate.

In a preferred aspect of the present invention, the first metallic projecting part is formed by folding a part of the second metallic plate using slits formed on the second metallic plate, the second metallic projecting part is formed by folding a part of the third metallic plate using slits formed on the third metallic plate.

The above and other objects of the present invention can be also accomplished by a dielectric filter, comprising:

a dielectric block which comprises:

a top surface;

a first side surface with a first metallization, being perpendicular to the top surface;

a second side surface with a second metallization, being opposite to the first side surface; and a third side surface with a third metallization, being perpendicular to the top surface and the first side surface; and a shield attachable to the dielectric block which comprises:

a first metallic plate;

a second metallic plate elongated from a first end of the first metallic plate in a predetermined direction and connecting with the first metallization;

a third metallic plate elongated from a second end of the first metallic plate opposite to the first end in the predetermined direction and connecting with the second metallization; and a metallic projecting part projecting from the first metallic plate at a portion between the first and second ends of the first metallic plate and connecting with the third metallization.

According to the present invention, because the total thickness of the dielectric filter is not increased by attaching the shield, it is enabled to satisfy the demand to thin the total thickness of the dielectric filter. Further, according to the present invention, because the distance between the shield and the dielectric block is fixed by the length of the metallic projecting part, the distance does not vary so that the fluctuation of the filter characteristics can be avoided. Moreover, since the shield after attached to the dielectric block has sufficient mechanical strength, the shield can be made of a thin metal plate.

In a preferred aspect of the present invention, the dielectric filter further comprises a top metallization formed on the top surface of the dielectric block, the top metallization and the third metallization being electrically connected to each other.

In a further preferred aspect of the present invention, the dielectric block has through holes passing from the third side surface to a fourth side surface opposite to the third surface.

In a further preferred aspect of the present invention, the metallic projecting part is elongated from a third end or its adjacent portion, the third end being perpendicular to the first end of the first metallic plate.

In a further preferred aspect of the present invention, the metallic projecting part is formed on substantially throughout between first and second ends of the first metallic plate.

In a further preferred aspect of the present invention, a fourth end of the first metallic plate opposite to the third end and a bottom surface of the dielectric block opposite to the top surface are substantially coplanar.

In a further preferred aspect of the present invention, the first metallic plate has a removed portion at the fourth end.

In a further preferred aspect of the present invention, the dielectric filter further comprises a fourth metallization formed on the third side surface of the dielectric block, the shield further comprising another metallic projection part being in contact with the fourth metallization elongated from the fourth end or its adjacent portion.

The above and other objects and features of the present invention will become apparent from the following description made with reference to the accompanying drawings.

BRIEF DESCRIPTION OF THE SEVERAL VIEWS OF THE DRAWINGS

FIG. 3(*b*) is a schematic sectional view showing the example that an inside portion 15 and an outside portion 16 of the corners of the shield 10 have a little dilated shape.

DETAILED DESCRIPTION OF THE INVENTION

Preferred embodiments of the present invention will now be explained with reference to the drawings.

Figure 1:
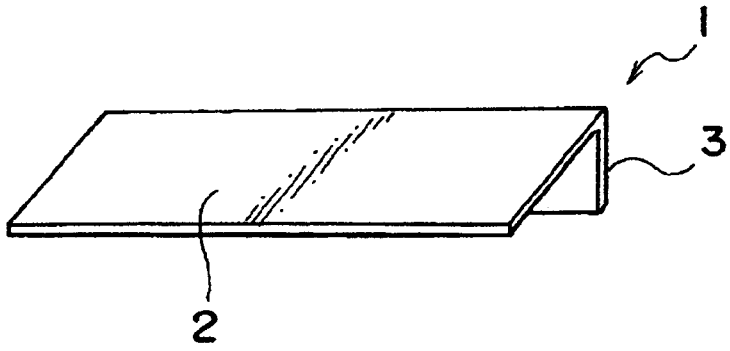
FIG. 1 PRIOR ART
FIG. 1 is a schematic perspective view showing a conventional shield 1.
Figure 2:
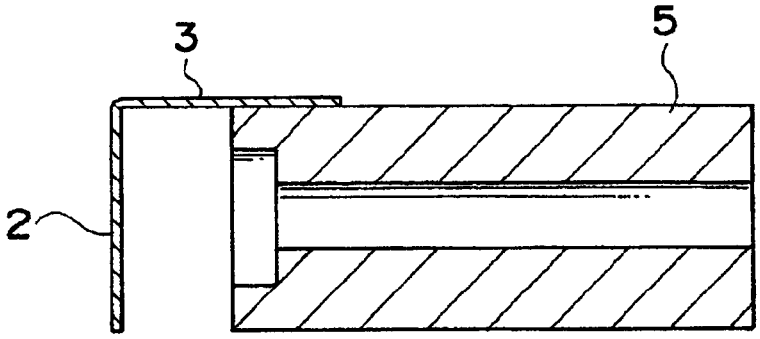
FIG. 2 PRIOR ART
FIG. 2 is a schematic sectional view showing the dielectric filter 5 equipped with the shield 1.
Figure 3A:
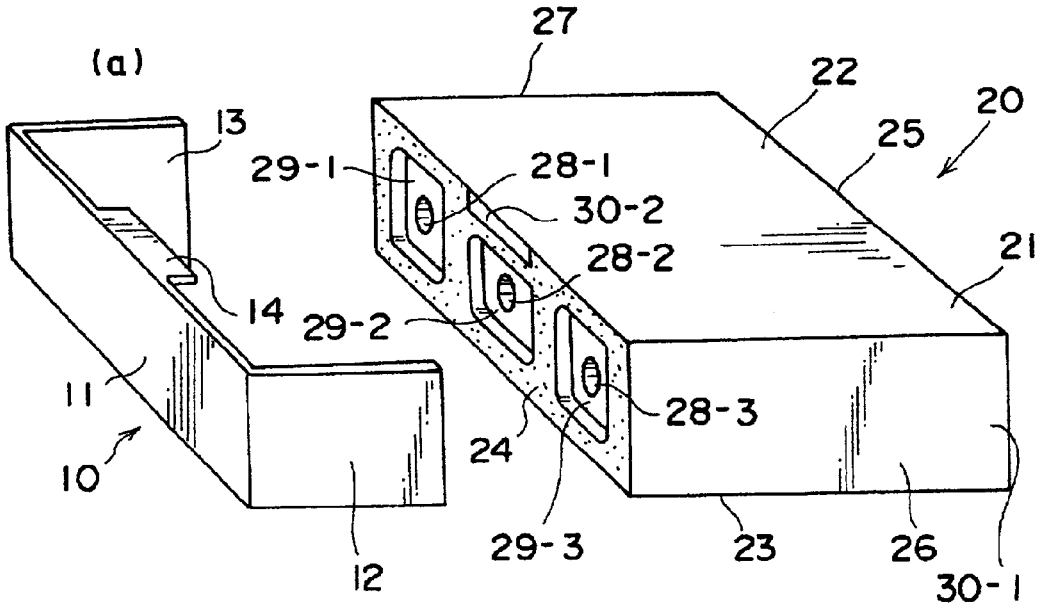
FIG. 3(*a*) is a schematic perspective view showing a shield 10 and a dielectric filter 20 to be equipped with the shield 10 that is a preferred embodiment of the present invention.
Figure 3B:
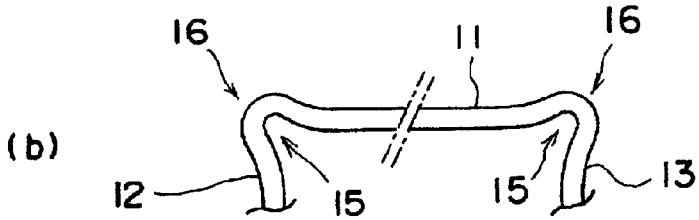

As shown in FIG. 3(*a*), the shield 10 has a first plate 11, second and third plates 12 and 13 bent substantially perpendicularly to the first plate 11 and a projecting part 14 formed at the upper edge of the first plate 11. The shield 10 can be fabricated by bending a piece of metal plate. As shown in FIG. 3(*b*), it is preferable that the inside portion 15 and the outside portion 16 of the bent portions of the first and second plates 41 and 42 and the first and third plates 41 and 43 have a little dilated shape.

The dielectric filter 20 is a band pass filter, and is constituted of a dielectric block 21 of substantially rectangular prismatic shape made of the ceramic material ($\epsilon_r$=92) in which the main component is barium titanate. The dielectric block 21 has a top surface 22, a bottom surface 23, side surfaces 24 to 27, and through holes 28-1, 28-2, and 28-3 passing from the side surface 24 to the side surface 25 opposite to the side surface 24. Further, cavities 29-1, 29-2, and 29-3 are formed on the side surface 24 at the portions corresponding to the through holes 28-1, 28-2, and 28-3, respectively.

A metallization 30-1 is provided on the entire top surface 22, the entire side surfaces 25 to 27, a part of the bottom surface 23 with prevented from contacting with the metallizations 31-1 and 31-2 as input/output terminals by the clearance portions 32, and the inner walls of the through holes 28-1, 28-2, and 28-3 and the cavities 29-1, 29-2, and 29-3; a metallization 30-2 is provided on the upper portion of the side surface 24 of the dielectric block 21. The metallizations 30-1 and 30-2 are electrically connected to each other. They are grounded when the dielectric filter 20 is mounted on the printed circuit board.

The resonators formed by the through holes 28-1, 28-2, and 28-3 are coupled to one another by the cavities 29-1, 29-2, and 29-3 formed on the side surfaces 24 of the dielectric block 21 so that the dielectric filter 20 acts as a band pass filter.

In FIG. 3(*a*), the metallized portions are shown in the color of the drawing sheet and the portion without metallization is speckled. The metallizations 30-1 and 30-2 are formed of silver paste. However, the present invention is not limited to using silver and other kinds of metal can be used instead.

The distance between the second plate 12 and the third plate 13 of the shield 10 is equal to or a little smaller than the width of the dielectric block 21 (distance between the side surface 26 to the side surface 27). Further, the distance between the lower edge of the first plate 11 and the projecting part 14 of the shield 10 is substantially equal to the distance between the bottom surface 23 of the dielectric block 21 and the metallization 30-2.

Next, a method to attach the shield 10 to the dielectric filter 20 will now be explained.

When attaching the shield 10 to the dielectric filter 20, the dielectric filter 20 should be lied on a planar stage so that the bottom surface 23 faces the stage, and insert the shield 10 such that the second and third plates 12 and 13 pinch the side surfaces 26 and 27 of the dielectric block 21. In this time, the lower edges of the first to third plates 11 to 13 of the shield 10 should be in contact with the stage and the projecting part 14 of the shield 10 should be in contact with the metallization 30-2 of the dielectric filter 20.

If the inside portion 15 and the outside portion 16 of the shield 10 are a little dilated as shown FIG. 3(*b*), the shield 10 can be attached to the dielectric filter 20 having the width greater than the distance between the second and third plates 12 and 13 since the second and third plates 12 and 13 act as a spring. Therefore, in the case where the shield 10 in which the inside portion 15 and the outside portion 16 of the shield 10 are a little dilated is used, the shield 10 can be surely attached to the dielectric filter 20 even if the width of the dielectric block 21 vary owing to the fabricating conditions.

Next, a solder metal of high temperature is provided to an interface between the shield 10 and the dielectric filter 20 and reflowing the solder metal to establish the electrical and mechanical connections therebetween. Then, attaching the shield 10 to the dielectric filter 20 is completed.

Figure 4:
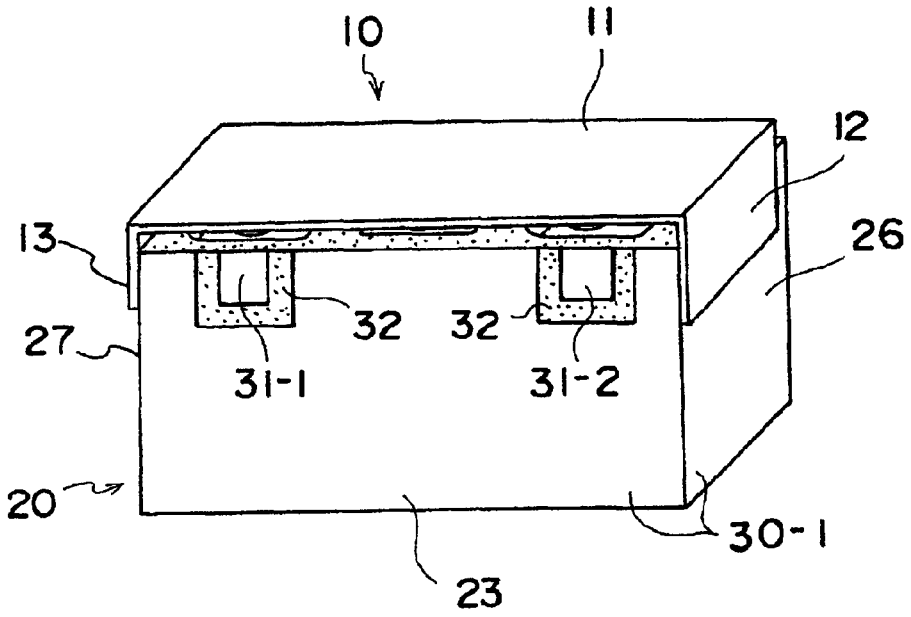
FIG. 4 is a schematic perspective view from a bottom surface of the dielectric block showing the dielectric filter 20 equipped with the shield 10.
Figure 5:
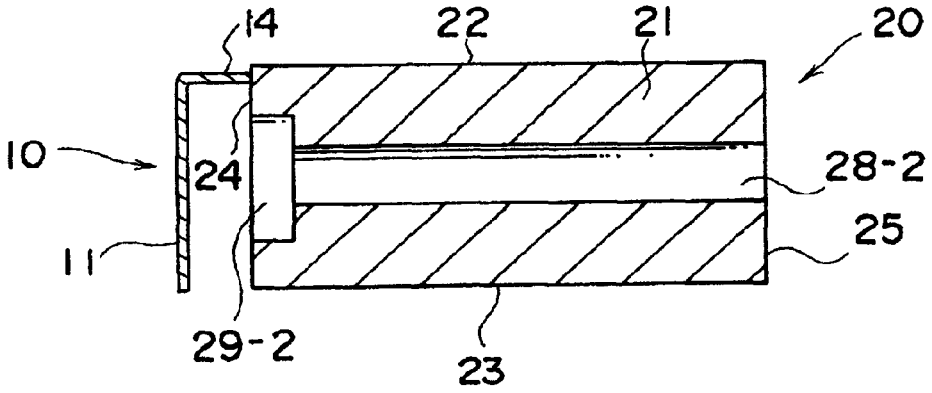
FIG. 5 is a schematic sectional view showing the dielectric filter 20 equipped with the shield 10.

FIG. 4 is a schematic perspective view from a bottom surface 23 of the dielectric block 21 showing the dielectric filter 20 equipped with the shield 10. FIG. 5 is a schematic sectional view showing the dielectric filter 20 equipped with the shield 10.

As shown in FIGS. 4 and 5, when the shield 10 is attached to the dielectric filter 20, the lower edge of the shield 10 and the bottom surface 23 of the dielectric block 21 are coplanar. Further, since the distance between the first plate 11 of the shield 10 and the side surface 24 of the dielectric block 21 is fixed by the length of the projecting part 14, the distance does not vary caused by a fluctuation of the fabricating conditions of the dielectric block 21. Moreover, since the projecting part 14 is in contact with the metallization 30-2 provided on the side surface 24 of the dielectric block 21, the total thickness of the dielectric filter 20 does not increase even the shield 10 is attached.

When the dielectric filter 20 equipped with the shield 10 is mounted on the printed circuit board, the metallizations 31-1 and 31-2 as input/output terminals are connected to the signal terminals of the printed circuit board, and the metallization 30-1 provided on the bottom surface 23 of the dielectric block 21 and the lower edge of the first plate 11 of the shield 10 are connected to the ground terminals of the printed circuit board. Thus, ground potential is applied to the metallization 30-1 provided on the top surface 22 of the dielectric block 21 via not only the metallization 30-1 provided on the side surfaces 25 to 27 of the dielectric block 21 but also the first plate 11 of the shield 10 and the metallization 30-2. Therefore, a fluctuation of the potential on the metallization 30-1 provided on the top surface 22 of the dielectric block 21 is effectively restrained.

In general, a solder is used to connect the metallizations of the dielectric filter 20 to the electrodes of the printed circuit board. In this case, after the soldering is completed, the printed circuit board is dipped into a clearing solvent in order to clean a soldering flux off. According to this embodiment, the clearing solvent is provided and discharged to/from the space formed between the shield 10 and the dielectric filter 20 via openings formed by the upper edge of the first plate 11 of the shield 10 except that the projecting part 14 is formed and the dielectric block 21.

Figure 6A:
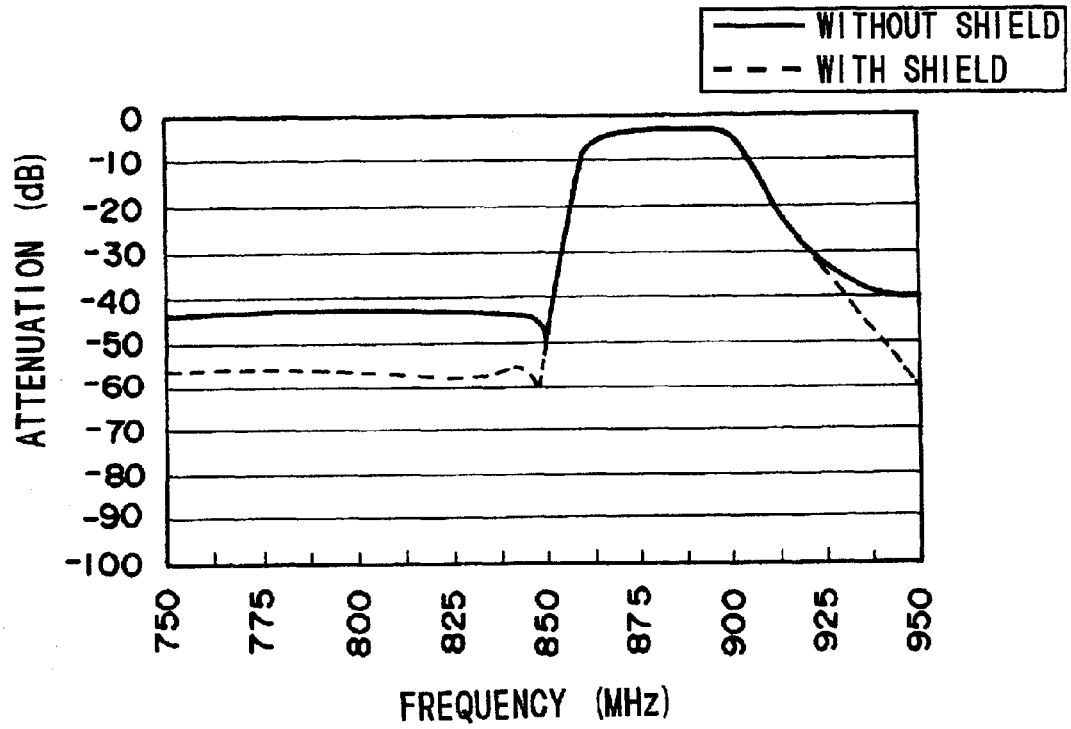
FIGS. 6(*a*) and 6(*b*) are graphs showing the effect of the shield 10.
Figure 6B:
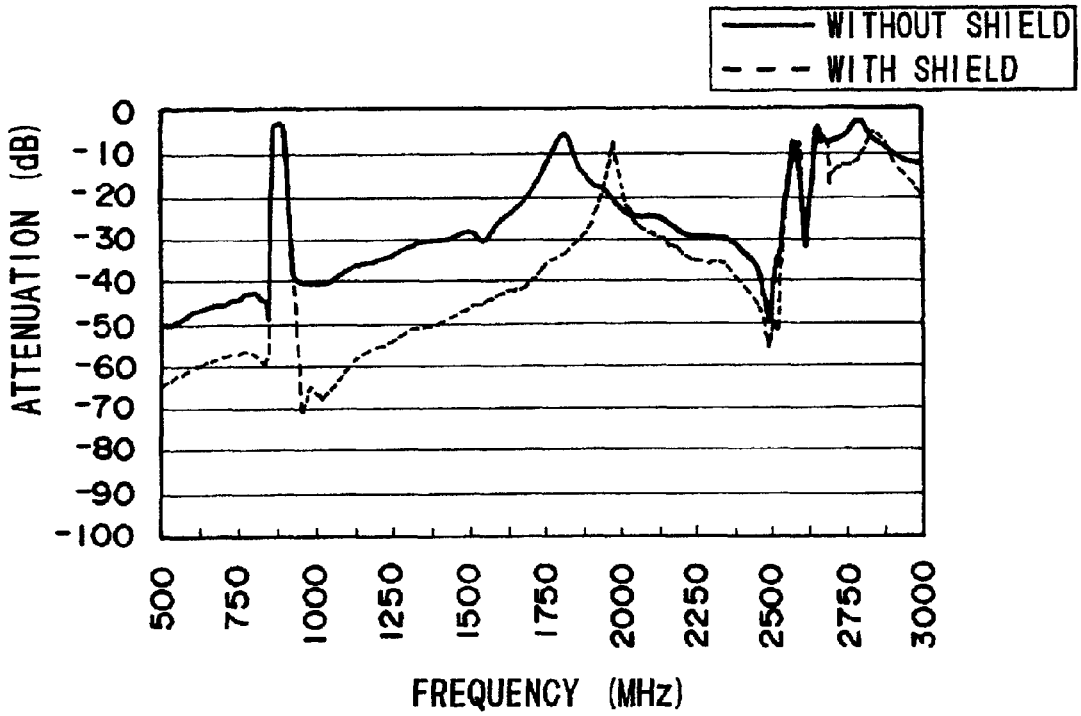

FIGS. 6(*a*) and 6(*b*) are graphs showing the effect of the shield 10.

As shown in FIGS. 6(*a*) and 6(*b*), an attenuation in the cut-off band is markedly increased by equipping the dielectric filter 20 with the shield 10.

As described above, the shield 10 of this embodiment is fixed to the dielectric filter 20 by pinching the side surfaces 26 and 27 of the dielectric block 21 and the projecting part 14 is in contact with the metallization 30-2 provided on the side surface 24 of the dielectric block 21. Therefore, a coplanarity of the lower edge of the shield 10 and the bottom surface 23 of the dielectric block 21 can be easily ensured. Further, because the distance between the first plate 11 of the shield 10 and the side surface 24 of the dielectric block 21 is fixed, the distance does not vary so that the fluctuation of the filter characteristics can be avoided. Moreover, since the total thickness of the dielectric filter 20 does not increase even the shield 10 is attached, it is enabled to satisfy the demand to thin.

Furthermore, because the shield 10 is fixed to the dielectric filter 20 by pinching the side surfaces 26 and 27 of the dielectric block 21, a mechanical strength of attached shield 10 is high compared with the conventional shield so that the thin metal plate can be used for the shield 10.

Another preferred embodiment of the present invention will now be explained.

Figure 7:
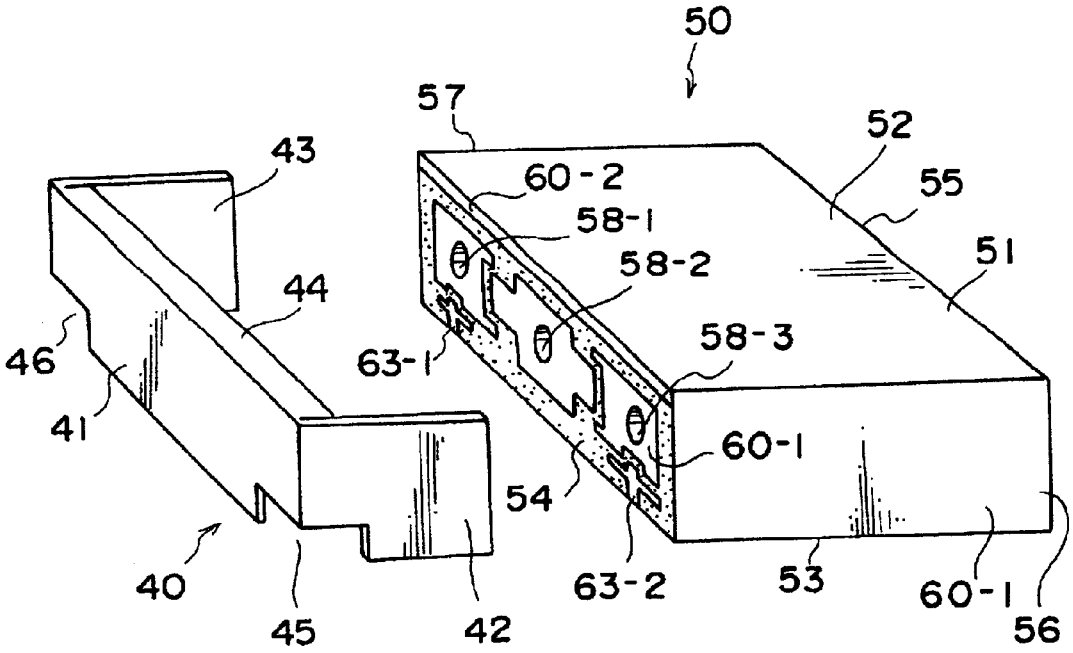
FIG. 7 is a schematic perspective view showing a shield 40 and a dielectric filter 50 to be equipped with the shield 40 that is another preferred embodiment of the present invention.

FIG. 7 is a schematic perspective view showing a shield 40 and a dielectric filter 50 to be equipped with the shield 40 that is another preferred embodiment of the present invention.

As shown in FIG. 7, the shield 40 has a first plate 41, second and third plate 42 and 43 bent substantially perpendicularly to the first plate 41 and a projecting part 44 formed at the upper edge of the first plate 41. The shield 40 has a removed portion 45 formed at the lower edges of the first and second plate 41 and 42 and a removed portion 46 formed at the lower edges of the first and third plates 41 and 43 different from the shield 10 of the above embodiment. Further, the shield 40 of this embodiment is different from the shield 10 that the projecting part 44 is formed on substantially throughout the upper edge of the first plate 41. The shield 40 can be fabricated by bending a piece of metal plate. It is preferable that the inside portion and the outside portion of the bent portions of the first and second plates 41 and 42 and the first and third plates 41 and 43 have a little dilated shape.

The dielectric filter 50 is a band pass filter, and is constituted of a dielectric block 51 of substantially rectangular prismatic shape made of the ceramic material ($\epsilon_r$=92) in which the main component is barium titanate. The dielectric block 51 has a top surface 52, a bottom surface 53, side surfaces 54 to 57, and through holes 58-1, 58-2, and 58-3 passing from the side surface 54 to the side surface 55 opposite to the side surface 54. No cavities are formed on the side surface 54, that is different from the dielectric filter 20.

A metallization 60-1 is provided on the entire top surface 52, the entire side surfaces 55 to 57, a part of the bottom surface 53 with prevented from contacting with the metallizations 61-1 and 61-2 as input/output terminals by the clearance portions 62, a part of the side surface 54, and the inner walls of the through holes 58-1, 58-2, and 58-3; a metallization 60-2 is provided on the upper portion of the side surface 54 of the dielectric block 51. The metallization 60-1 provided on the side surface 54 has a predetermined pattern. The metallizations 60-1 and 60-2 are electrically connected to each other. They are grounded when the dielectric filter 50 is mounted on the printed circuit board.

Metallizations 63-1 and 63-2 are also provided on the side surface 54 of the dielectric block 51. The metallizations 63-1 and 63-2 are connected to the metallizations 61-1 and 61-2 as input/output terminals, respectively.

The resonators formed by the through holes 58-1, 58-2, and 58-3 are coupled to one another by the metallization 60-1 provided on the side surfaces 54 of the dielectric block 51 so that the dielectric filter 50 acts as a band pass filter.

The distance between the second plate 42 and the third plate 43 of the shield 40 is equal to or a little smaller than the width of the dielectric block 51 (distance between the side surface 56 to the side surface 57). Further, the distance between the lower edge of the first plate 41 and the projecting part 44 of the shield 40 is substantially equal to the distance between the bottom surface 53 of the dielectric block 51 and the metallization 60-2.

The same method can be used to attach the shield 40 to the dielectric filter 50 that described above. Specifically, when attaching the shield 40 to the dielectric filter 50, the dielectric filter 50 should be lied on a planar stage so that the bottom surface 53 faces the stage, and inserts the shield 40 such that the second and third plates 42 and 43 pinch the side surfaces 56 and 57 of the dielectric block 51. In this time, the lower edges of the first to third plates 41 to 43 of the shield 40 should be in contact with the stage and the projecting part 44 of the shield 40 should be in contact with the metallization 60-2 of the dielectric filter 50. Next, a solder metal of high temperature is provided to an interface between the shield 40 and the dielectric filter 50 and reflowing the solder metal to establish the electrical and mechanical connections therebetween. Then, attaching the shield 40 to the dielectric filter 50 is completed.

Figure 8:
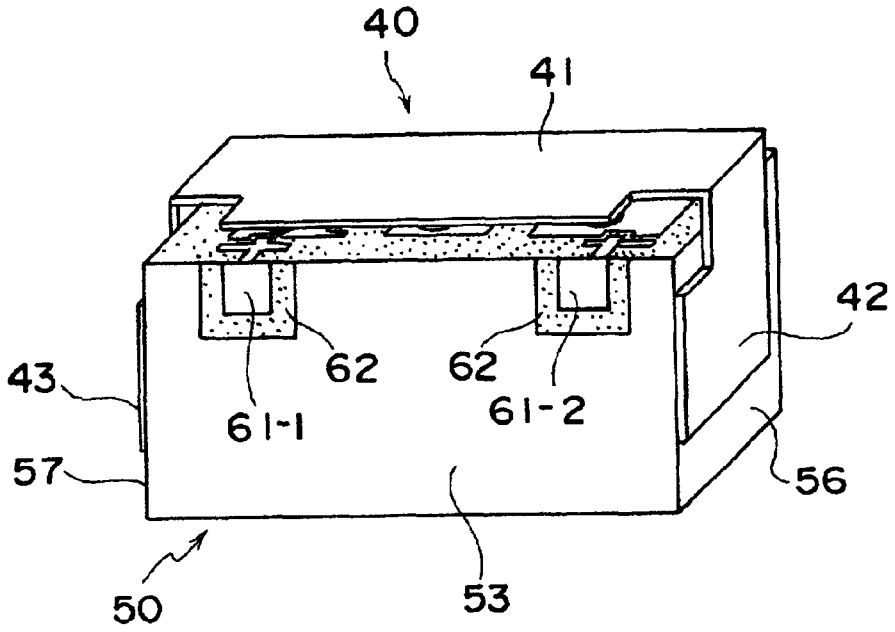
FIG. 8 is a schematic perspective view from a bottom surface of the dielectric block showing the dielectric filter 50 equipped with the shield 40.
Figure 9:
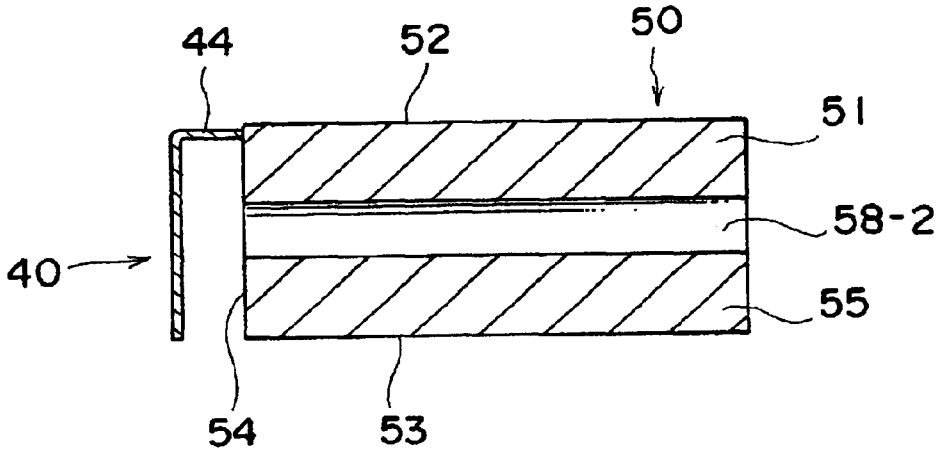
FIG. 9 is a schematic sectional view showing the dielectric filter 50 equipped with the shield 40.

FIG. 8 is a schematic perspective view from a bottom surface 53 of the dielectric block 51 showing the dielectric filter 50 equipped with the shield 40. FIG. 9 is a schematic sectional view showing the dielectric filter 50 equipped with the shield 40.

As shown in FIGS. 8 and 9, when the shield 40 is attached to the dielectric filter 50, the lower edge of the shield 40 and the bottom surface 53 of the dielectric block 51 are coplanar similar to the above described embodiment. Further, since the distance between the first plate 41 of the shield 40 and the side surface 54 of the dielectric block 51 is fixed by the length of the projecting part 44, the distance does not vary caused by a fluctuation of the fabricating conditions of the dielectric block 51. Moreover, since the projecting part 44 is in contact with the metallization 60-2 provided on the side surface 54 of the dielectric block 51, the total thickness of the dielectric filter 50 does not increase even the shield 40 is attached.

When the dielectric filter 50 equipped with the shield 40 is mounted on the printed circuit board, the metallizations 61-1 and 61-2 as input/output terminals are connected to the signal terminals of the printed circuit board, and the metallization 60-1 provided on the bottom surface 53 of the dielectric block 51 and the lower edge of the first plate 41 of the shield 40 are connected to the ground terminals of the printed circuit board. Thus, the ground potential is applied to the metallization 60-1 provided on the top surface 52 of the dielectric block 51 via not only the metallization 60-1 provided on the side surfaces 55 to 57 of the dielectric block 51 but also the first plate 41 of the shield 40 and the metallization 60-2. Therefore, a fluctuation of the potential on the metallization 60-1 provided on the top surface 52 of the dielectric block 51 is effectively restrained.

Moreover, since the shield 40 of this embodiment has the removed portions 45 and 46, the signal wirings elongated from the signal electrodes which are connected to the metallizations 61-1 and 61-2 can be led out through the removed portions 45 and 46. Furthermore, the clearing solvent can be easily provided and discharged to/from the space formed between the shield 40 and the dielectric filter 50 via the removed portions 45 and 46.

As described above, according to the shield 40 of this embodiment, similar effects obtaining by the shield 10 can be also obtained: a coplanarity of the lower edge of the shield 40 and the bottom surface 53 of the dielectric block 51 can be also easily ensured; the distance between the first plate 41 of the shield 40 and the side surface 54 of the dielectric block 51 does not vary; and the total thickness of the dielectric filter 50 does not increase even the shield 40 is attached. In addition to these effects, since the shield 40 of this embodiment has the removed portions 45 and 46, an effect that the signal wirings connected to the metallizations 61-1 and 61-2 can be led out through the removed portions 45 and 46 is obtained.

Further preferred embodiment of the present invention will now be explained.

Figure 10:
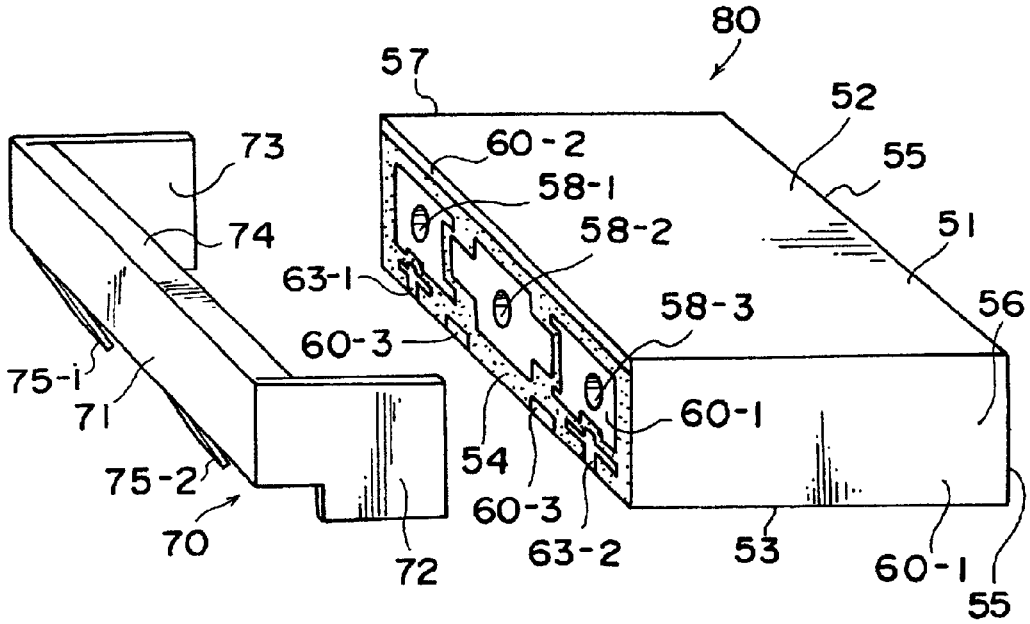
FIG. 10 is a schematic perspective view showing a shield 70 and a dielectric filter 80 to be equipped with the shield 70 that is a further preferred embodiment of the present invention.

FIG. 10 is a schematic perspective view showing a shield 70 and a dielectric filter 80 to be equipped with the shield 70 that is a further preferred embodiment of the present invention.

As shown in FIG. 10, the shield 70 has a first plate 71, second and third plates 72 and 73 bent substantially perpendicularly to the first plate 71, a first projecting part 74 formed at the upper edge of the first plate 71, and second projecting parts 75-1 and 75-2 elongated from the lower edge of the first plate 71. The distance between the first plate 71 and the tip of the first projecting part 74 according to a horizontal direction is substantially the same as the distance between the first plate 71 and the tips of the second projecting parts 75-1 and 75-2 according to a horizontal direction. It is preferable that the inside portion and the outside portion of the bent portions of the first and second plates 71 and 72 and the first and third plates 71 and 73 have a little dilated shape.

The dielectric filter 80 is a band pass filter, and has the same structure as the dielectric filter 50 except that the metallization 60-3 is provided on the side surface 54 of the dielectric block 51. The metallization 60-3 is connected to the metallization 60-1 provided on the bottom surface 53 of the dielectric block 51.

The distance between the second plate 72 and the third plate 73 of the shield 70 is equal to or a little smaller than the width of the dielectric block 51 (distance between the side surface 56 to the side surface 57). Further, the distance between the tip of the first projecting part 74 and tips of the second projecting parts 75-1 and 75-2 according to a vertical direction is substantially equal to the distance between the metallizations 60-2 and 60-3 provided on the side surface 54 of the dielectric block 51.

The same method can be used to attach the shield 70 to the dielectric filter 80 that described above. Specifically, when attaching the shield 70 to the dielectric filter 80, the dielectric filter 80 should be lied on a planar stage so that the bottom surface 53 faces the stage, and inserts the shield 70 such that the second and third plates 72 and 73 pinch the side surfaces 56 and 57 of the dielectric block 51. In this time, the lower edges of the second and third plates 72 and 73 of the shield 70 should be in contact with the stage, the first projecting part 74 of the shield 70 should be in contact with the metallization 60-2 of the dielectric filter 80, and the second projecting parts 75-1 and 75-2 of the shield 70 should be in contact with the metallization 60-3 of the dielectric filter 80. Next, a solder metal of high temperature is provided to an interface between the shield 70 and the dielectric filter 80 and reflowing the solder metal to establish the electrical and mechanical connections therebetween. Then, attaching the shield 70 to the dielectric filter 80 is completed.

Figure 11:
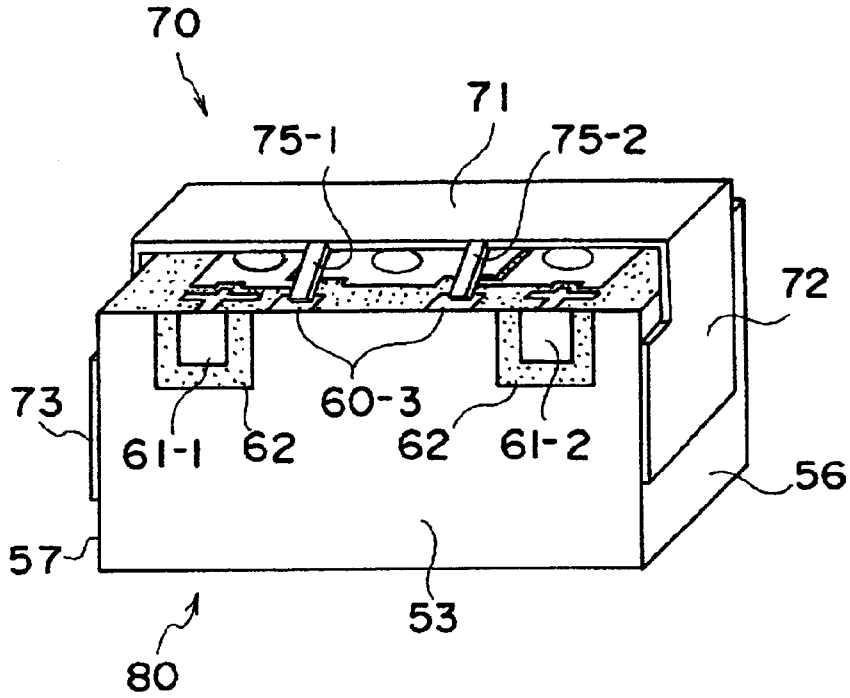
FIG. 11 is a schematic perspective view from a bottom surface of the dielectric block showing the dielectric filter 80 equipped with the shield 70.
Figure 12:
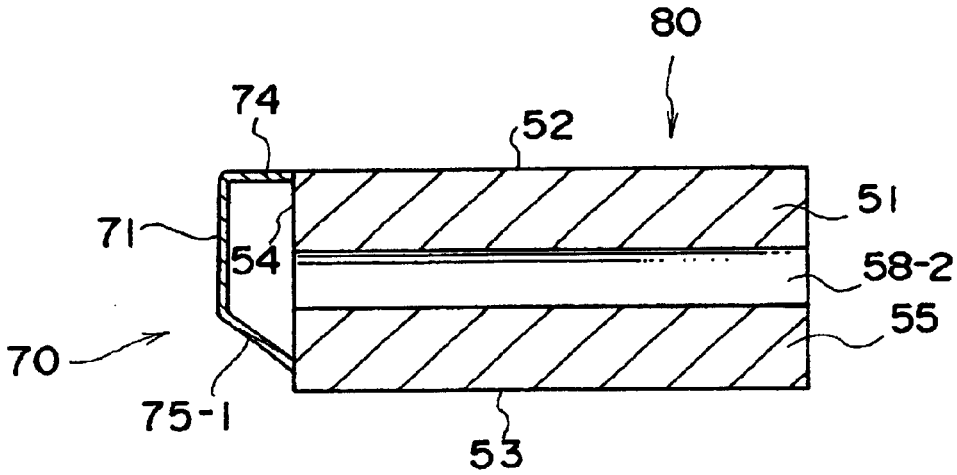
FIG. 12 is a schematic sectional view showing the dielectric filter 80 equipped with the shield 70.

FIG. 11 is a schematic perspective view from a bottom surface 53 of the dielectric block 51 showing the dielectric filter 80 equipped with the shield 70. FIG. 12 is a schematic sectional view showing the dielectric filter 80 equipped with the shield 70.

As shown in FIGS. 11 and 12, when the shield 70 is attached to the dielectric filter 80, since the distance between the first plate 71 of the shield 70 and the side surface 54 of the dielectric block 51 is fixed by the length of the first projecting part 74, the distance does not vary caused by a fluctuation of the fabricating conditions of the dielectric block 51. Moreover, since the first projecting part 74 is in contact with the metallization 60-2 provided on the side surface 54 of the dielectric block 51, the total thickness of the dielectric filter 80 does not increase even the shield 70 is attached.

When the dielectric filter 80 equipped with the shield 70 is mounted on the printed circuit board, the metallizations 61-1 and 61-2 as input/output terminals are connected to the signal terminals of the printed circuit board, and the metallization 60-1 provided on the bottom surface 53 of the dielectric block 51 is connected to the ground terminals of the printed circuit board. Thus, the ground potential is applied to the metallization 60-1 provided on the top surface 52 of the dielectric block 51 via not only the metallization 60-1 provided on the side surfaces 55 to 57 of the dielectric block 51 but also the metallization 60-3, the first plate 71 of the shield 70 and the metallization 60-2. Therefore, a fluctuation of the potential on the metallization 60-1 provided on the top surface 52 of the dielectric block 51 is effectively restrained.

Moreover, since the gap is formed between the lower edge of the first plate 71 of the shield 70 and the printed circuit board, the signal wirings elongated from the signal electrodes which are connected to the metallizations 61-1 and 61-2 can be easily led out through the gap. Furthermore, the clearing solvent can be easily provided and discharged to/from the space formed between the shield 70 and the dielectric filter 80 via the gap.

As described above, according to the shield 70 of this embodiment, similar effects obtaining by the shields 10 and 40 can be also obtained: the distance between the first plate 71 of the shield 70 and the side surface 54 of the dielectric block 51 does not vary; and the total thickness of the dielectric filter 80 does not increase even the shield 70 is attached. In addition to these effects, according to this embodiment, since the ground potential is applied to the shield 70 via the metallization 60-3 provided on the side surface 54 of the dielectric block 51, no ground electrode is required to connect to the shield 70. Therefore, a degree of freedom of a design can be increased.

Further preferred embodiment of the present invention will now be explained.

This embodiment is an example that the shield 40 that is above described embodiment is attached to a dielectric filter consisting of a plurality of resonators each of which is constituted of an individual dielectric block.

Figure 13:
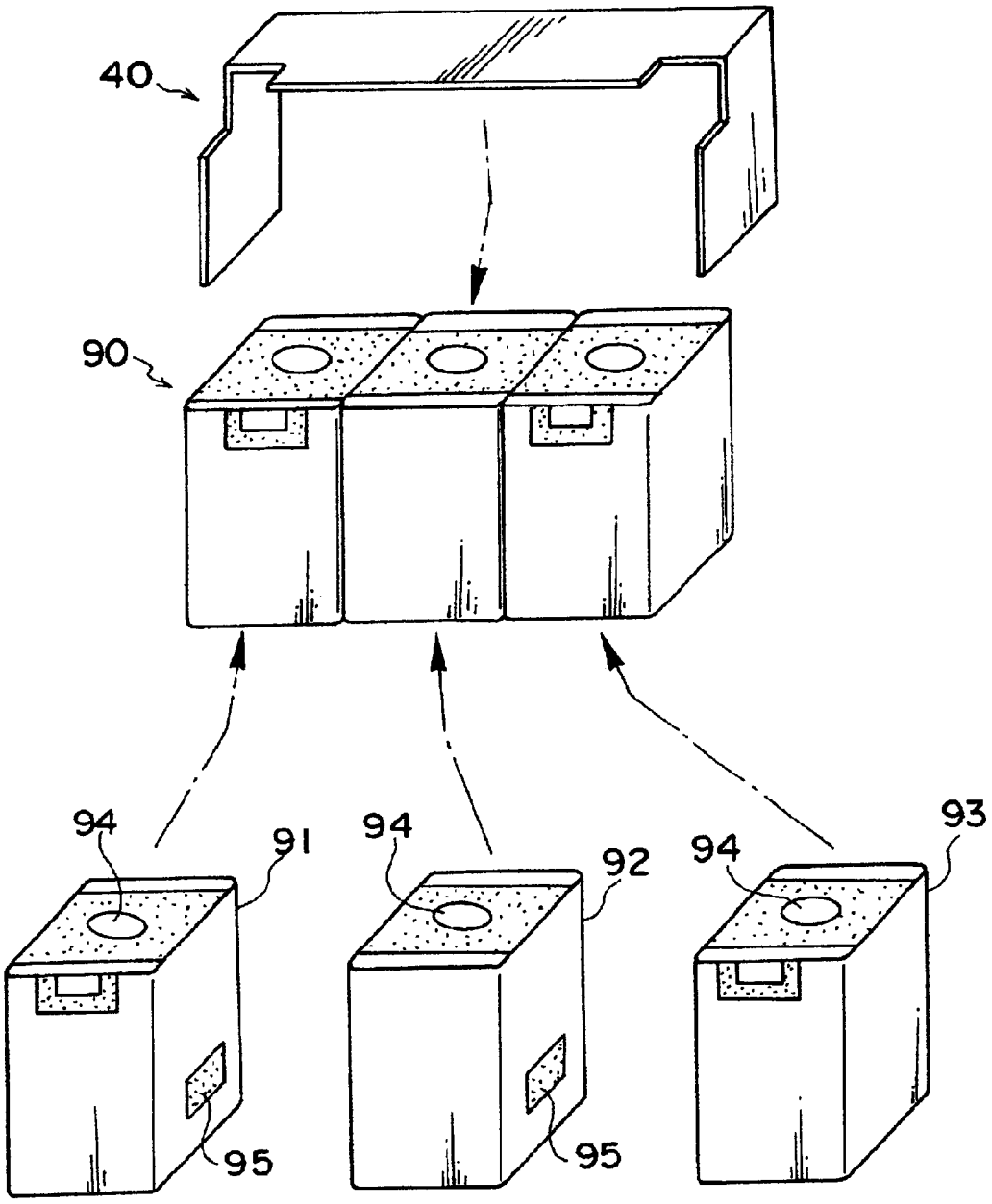
FIG. 13 is a schematic perspective view showing a dielectric filter 90 consisting of resonators 91 to 93 and a shield 40 to be attached thereto.

FIG. 13 is a schematic perspective view showing a dielectric filter 90 consisting of resonators 91 to 93 and the shield 40 to be attached thereto.

As shown in FIG. 13, the dielectric filter 90 to be equipped with the shield 40 consists of three resonators 91 to 93 each of which is constituted of an individual dielectric block. These dielectric blocks have through holes 94 passing from one side surface to the opposite surface and the metallizations provided on the predetermined portions. Coupling between these resonators 91 to 93 is established by exposed portions 95 where no metallization is provided.

As described above, the present invention can be applied to the dielectric filter 90 having aforementioned configuration. The dielectric filter 90 is suitable for a custom production because the dielectric filter 90 can be configured by selecting from general resonators (such as the resonators 91 to 93) based on the required characteristics.

Still further preferred embodiment of the present invention will now be explained.

This embodiment is an example that the coupling between the resonators is established by chip components.

Figure 14:
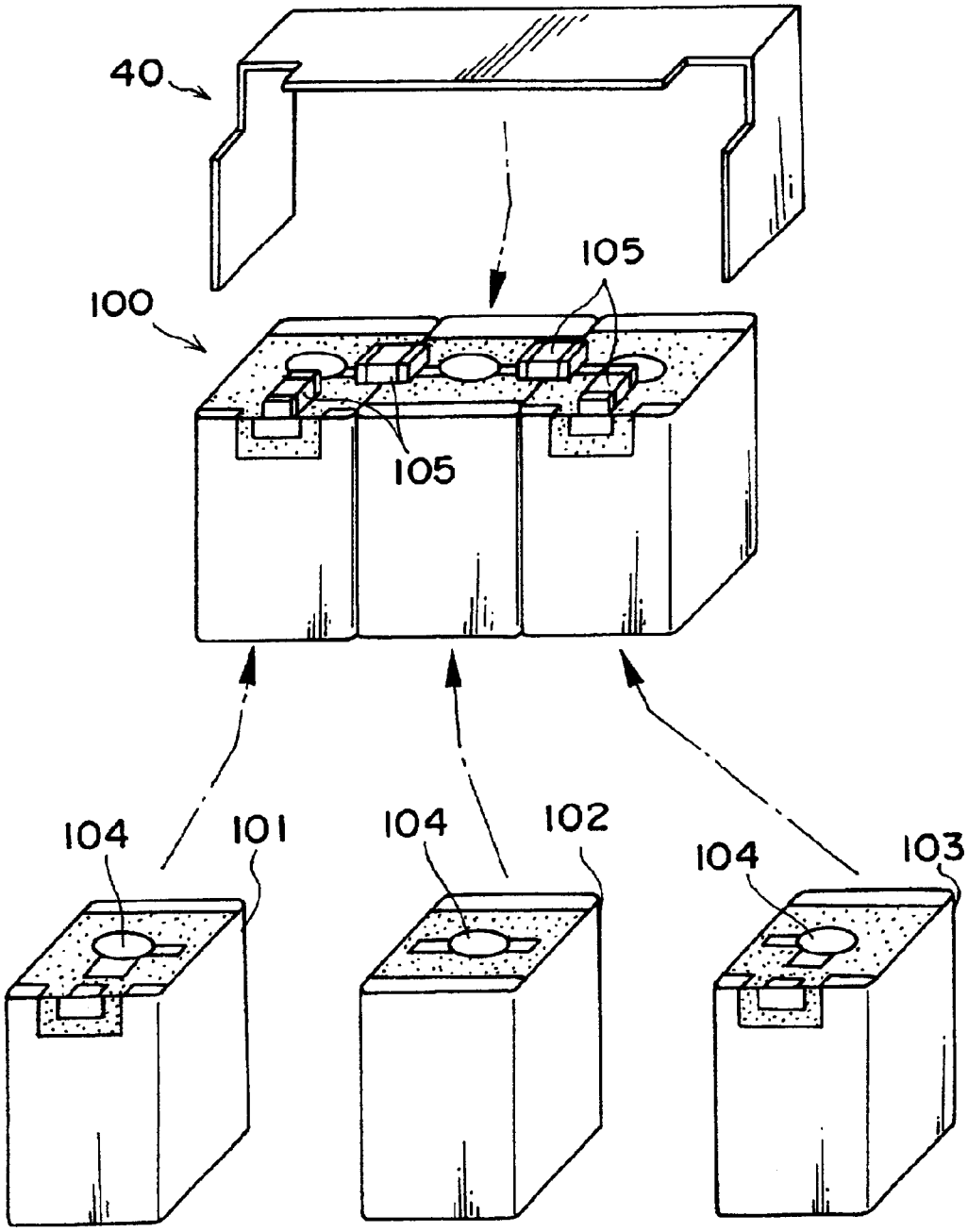
FIG. 14 is a schematic perspective view showing a dielectric filter 100 consisting of resonators 101 to 103 and a shield 40 to be attached thereto.

FIG. 14 is a schematic perspective view showing a dielectric filter 100 consisting of resonators 101 to 103 and the shield 40 to be attached thereto.

As shown in FIG. 14, the dielectric filter 100 to be equipped with the shield 40 consists of three resonators 101 to 103 each of which is constituted of an individual dielectric block. These dielectric blocks have through holes 104 passing from one side surface to the opposite surface and the metallizations provided on the predetermined portions. Coupling between these resonators 101 to 103 is established by chip components 105 mounted thereon.

As described above, the present invention can be applied to the dielectric filter 100 having aforementioned configuration. The dielectric filter 100 is suitable for a custom production because the dielectric filter 100 can be configured by selecting from general resonators (such as the resonators 101 to 103) and by selecting from general chip components (such as the components 105) based on the required characteristics.

Still further preferred embodiments of the present invention will now be explained.

Figure 15:
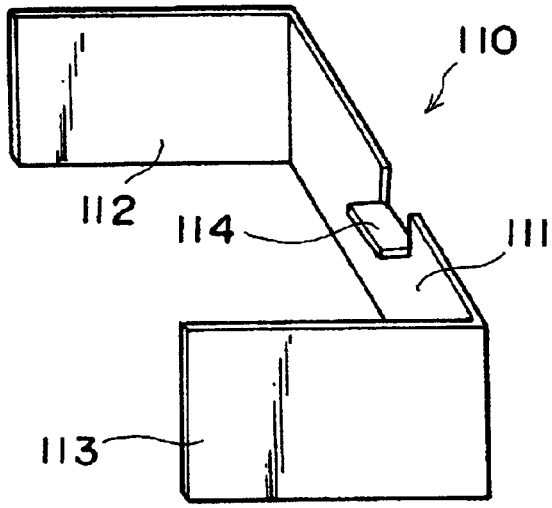
FIG. 15 is a schematic perspective view showing a shield 110 that is a further preferred embodiment of the present invention.

FIG. 15 is a schematic perspective view showing a shield 110 that is a further preferred embodiment of the present invention.

As shown in FIG. 15, the shield 110 has a first plate 111, second and third plates 112 and 113 bent substantially perpendicularly to the first plate 111 and a projecting part 114 formed by folding downward the upper portion of the first plate 111 using two parallel slits formed on the first plate 111. The shield 110 can be also fabricated by bending a piece of metal plate.

Figure 16:
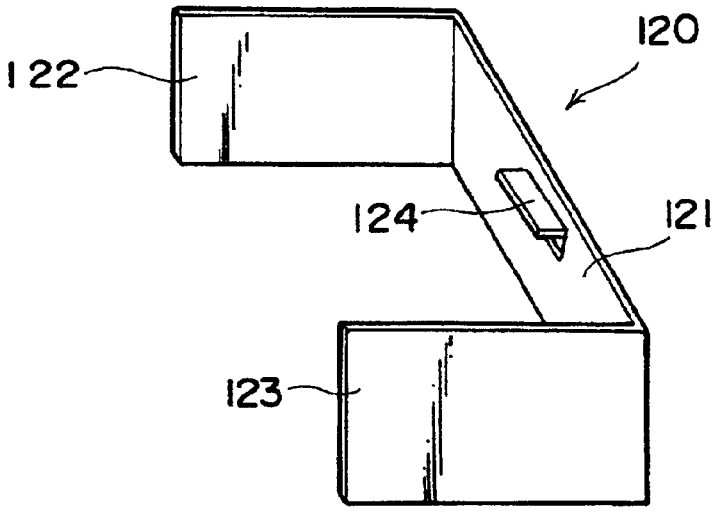
FIG. 16 is a schematic perspective view showing a shield 120 that is a further preferred embodiment of the present invention.

FIG. 16 is a schematic perspective view showing a shield 120 that is a further preferred embodiment of the present invention.

As shown in FIG. 16, the shield 120 has a first plate 121, second and third plates 122 and 123 bent substantially perpendicularly to the first plate 121 and a projecting part 124 formed by folding upward the upper portion of the first plate 121 using three slits formed on the first plate 121. The shield 120 can be also fabricated by bending a piece of metal plate.

Figure 17:
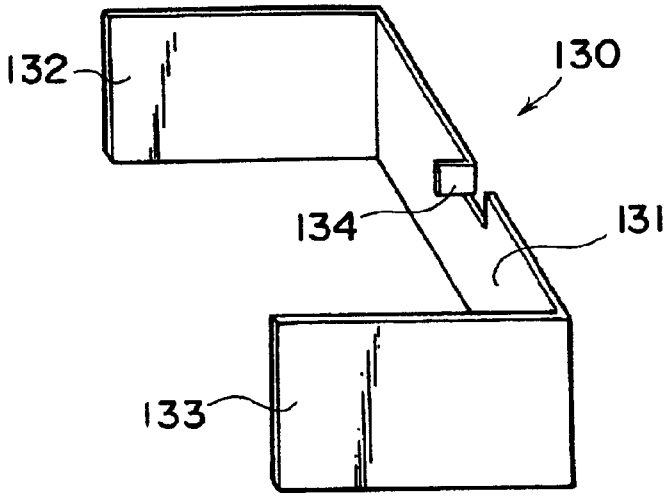
FIG. 17 is a schematic perspective view showing a shield 130 that is a further preferred embodiment of the present invention.

FIG. 17 is a schematic perspective view showing a shield 130 that is a further preferred embodiment of the present invention.

As shown in FIG. 17, the shield 130 has a first plate 131, second and third plates 132 and 133 bent substantially perpendicularly to the first plate 131 and a projecting part 134 formed by folding sideways the upper portion of the first plate 131 using two slits perpendicular to each other formed on the first plate 131. The shield 130 can be also fabricated by bending a piece of metal plate.

Figure 18:
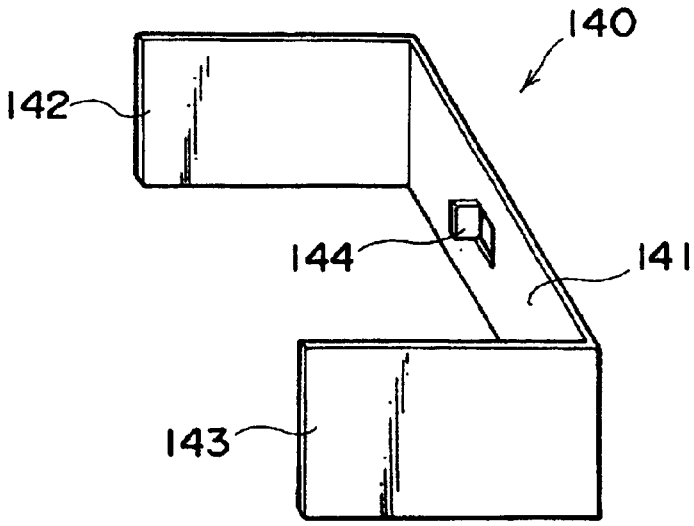
FIG. 18 is a schematic perspective view showing a shield 140 that is a further preferred embodiment of the present invention.

FIG. 18 is a schematic perspective view showing a shield 140 that is a further preferred embodiment of the present invention.

As shown in FIG. 18, the shield 140 has a first plate 141, second and third plates 142 and 143 bent substantially perpendicularly to the first plate 141 and a projecting part 144 formed by folding sideways the upper portion of the first plate 141 using three slits formed on the first plate 141. The shield 140 can be also fabricated by bending a piece of metal plate.

Figure 19:
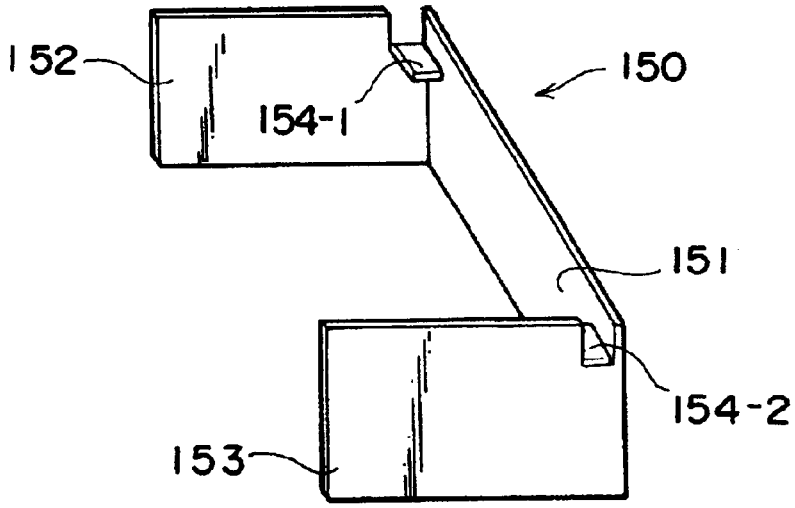
FIG. 19 is a schematic perspective view showing a shield 150 that is a further preferred embodiment of the present invention.

FIG. 19 is a schematic perspective view showing a shield 150 that is a further preferred embodiment of the present invention.

As shown in FIG. 19, the shield 150 has a first plate 151, second and third plates 152 and 153 bent substantially perpendicularly to the first plate 151, a first projecting part 154-1 formed by folding downward the upper portion of the second plate 152 using a first slit formed on the edge along the first plate 151 and a second slit parallel to the first slit, and a second projecting part 154-2 formed by folding downward the upper portion of the third plate 153 using a third slit formed on the edge along the first plate 151 and a fourth slit parallel to the third slit. The shield 150 can be also fabricated by bending a piece of metal plate.

Figure 20:
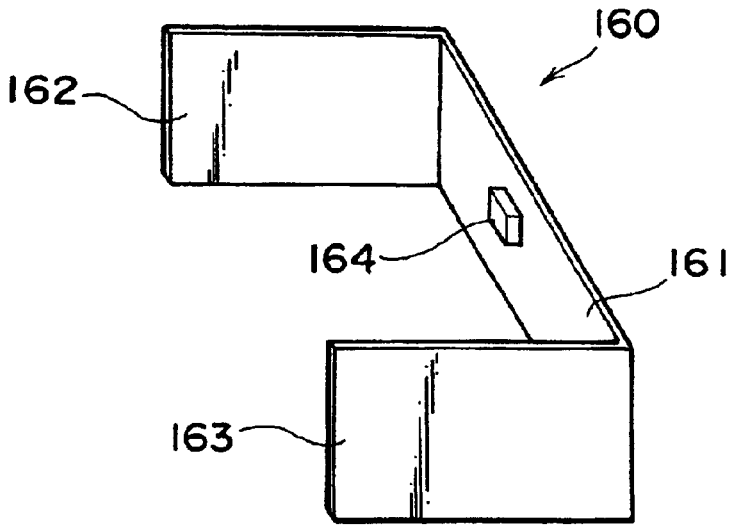
FIG. 20 is a schematic perspective view showing a shield 160 that is a further preferred embodiment of the present invention.

FIG. 20 is a schematic perspective view showing a shield 160 that is a further preferred embodiment of the present invention.

As shown in FIG. 20, the shield 160 has a first plate 161, second and third plates 162 and 163 bent substantially perpendicularly to the first plate 161 and a projecting member 164 adhered to the upper portion of the first plate 161. The shield 160 can be fabricated by bending a piece of metal plate and adhering the projecting member 164.

The present invention has been shown and described with reference to specific embodiments. However, it should be noted that the present invention is in no way limited to the details of the described arrangements but changes and modifications may be made without departing from the scope of the appended claims.

For example, in the above described embodiments, a ceramic composed mainly of barium titanate is used as the material of the dielectric blocks. However, the present invention is not limited to use of this material and dielectric blocks can instead be made of any of various other materials such as ceramic of barium oxide type.

Further, in the above described embodiments, although silver paste is used as the material of the metallizations, the present invention is not limited to use of silver paste and any of various other conductive materials, copper (coppering), for example, can be used instead. In case of using coppering as the material of the metallizations, the copper plating can be performed with a resist formed on the portion where the metallizations should not be formed in advance. It is preferable to use an electroless plating.

Moreover, in the above described embodiments, although each dielectric filter to be equipped with the shield is the band pass filter, the present invention is not limited that the dielectric filter to be equipped with the shield is the band pass filter but the shield of the present invention can be attached to other kinds of dielectric filter such as duplexer.

As described above, according to the present invention, the shield that can prevent the thickness of a dielectric filter from increasing without increasing the manufacturing cost of the dielectric filter and the dielectric filter equipped therewith can be provided.

What is claimed is:

1. A shield attachable to a dielectric filter, comprising:

a first metallic plate;

a second metallic plate elongated from a first end of the first metallic plate in a predetermined direction, the first end of the first metallic plate forming an intersection with the second metallic plate, the intersection of the first and second plate having a dilated shape;

a third metallic plate elongated from a second end of the first metallic plate opposite to the first end in the predetermined direction, the second end of the first metallic plate forming an intersection with the third metallic plate, the intersection of the first and third plate having a dilated shape; and a metallic projecting part projecting from the first metallic plate at a portion between the first and second ends of the first metallic plate.

2. The shield as claimed in claim 1, wherein a length of the metallic projecting part according to the predetermined direction is shorter than either lengths of the second and third metallic plates according to the predetermined direction.

3. The shield as claimed in claim 1, wherein the metallic projecting part is elongated from a third end or an adjacent portion thereof, the third end being perpendicular to the first end of the first metallic plate.

4. The shield as claimed in claim 3, wherein the metallic projecting part is formed on substantially throughout between first and second ends of the first metallic plate.

5. The shield as claimed in claim 3, wherein the metallic projecting part is formed by folding a part of the first metallic plate using slits formed on the first metallic plate.

6. The shield as claimed in claim 3, wherein the metallic projecting part is made of projection member attached to the first metallic plate.

7. The shield as claimed in claim 3, wherein the first metallic plate has a removed portion at a fourth end opposite to the third end.

8. The shield as claimed in claim 3, further comprising another metallic projecting part elongated from a fourth end or its adjacent portion, the fourth end being opposite to the third end.

9. A shield attachable to a dielectric filter, comprising:

a first metallic plate;

a second metallic plate elongated from a first end of the first metallic plate in a predetermined direction, the first end of the first metallic plate forming an intersection with the second metallic plate, the intersection of the first and second plate having a dilated shape;

a third metallic plate elongated from a second end of the first metallic plate opposite to the first end in the predetermined direction, the second end of the first metallic plate forming an intersection with the third metallic plate, the intersection of the first and third plate having a dilated shape;

a first metallic projecting part projecting from the second metallic plate toward the third metallic plate; and a second metallic projecting part projecting from the third metallic plate toward the second metallic plate.

10. The shield as claimed in claim 9, wherein the first metallic projecting part is formed by folding a part of the second metallic plate using slits formed on the second metallic plate, the second metallic projecting part is formed by folding a part of the third metallic plate using slits formed on the third metallic plate.

11. A dielectric filter, comprising:

a dielectric block which comprises:

a top surface;

a first side surface with a first metallization, being perpendicular to the top surface;

a second side surface with a second metallization, being opposite to the first side surface; and a third side surface with a third metallization, being perpendicular to the top surface and the first side surface; and a shield attachable to the dielectric block which comprises:

a first metallic plate;

a second metallic plate elongated from a first end of the first metallic plate in a predetermined direction and connecting with the first metallization, the first end of the first metallic plate forming an intersection with the second metallic plate, the intersection of the first and second plate having a dilated shape;

a third metallic plate elongated from a second end of the first metallic plate opposite to the first end in the predetermined direction and connecting with the second metallization, the second end of the first metallic plate forming an intersection with the third metallic plate, the intersection of the first and third plate having a dilated shape; and a metallic projecting part projecting from the first metallic plate at a portion between the first and second ends of the first metallic plate and connecting with the third metallization.

12. The dielectric filter as claimed in claim 11, further comprising a top metallization formed on the top surface of the dielectric block, the top metallization and the third metallization being electrically connected to each other.

13. The dielectric filter as claimed in claim 11, wherein the dielectric block has through holes passing from the third side surface to a fourth side surface opposite to the third surface.

14. The dielectric filter as claimed in claim 11, wherein the metallic projecting part is elongated from a third end or an adjacent portion thereof, the third end being perpendicular to the first end of the first metallic plate.

15. The dielectric filter as claimed in claim 14, wherein the metallic projecting part is formed on substantially throughout between first and second ends of the first metallic plate.

16. The dielectric filter as claimed in claim 14, wherein a fourth end of the first metallic plate opposite to the third end and a bottom surface of the dielectric block opposite to the top surface are substantially coplanar.

17. The dielectric filter as claimed in claim 16, wherein the first metallic plate has a removed portion at the fourth end.

18. The dielectric filter as claimed in claim 16, further comprising a fourth metallization formed on the third side surface of the dielectric block, the shield further comprising another metallic projection part being in contact with the fourth metallization elongated from the fourth end or an adjacent portion thereof.

* * * * *